United States Patent [19]

Chen

[11] Patent Number: 4,780,994

[45] Date of Patent: Nov. 1, 1988

[54] HONEYCOMB TYPE OF STRUCTURE FOR INTERMENT OF HUMAN REMAINS

[76] Inventor: Pang T. Chen, 2F1., No. 2, Lane 30, Section 1, Fu-Hsing South Road, Taipei, Taiwan

[21] Appl. No.: 46,236

[22] Filed: May 4, 1987

[51] Int. Cl.[4] ..... E04H 13/00

[52] U.S. Cl. ..... 52/30; 52/169.1; 52/134

[58] Field of Search ..... 52/128–142, 52/169.1, 169.6, 169.8, 169.9, 30

[56] References Cited

U.S. PATENT DOCUMENTS 1,096,758 5/1914 Rogers ..... 52/134
1,752,572 4/1930 Person ..... 52/134

FOREIGN PATENT DOCUMENTS 5699 of 1894 United Kingdom ..... 52/128
226064 12/1924 United Kingdom ..... 52/30

*Primary Examiner*—James L. Ridgill, Jr.
*Attorney, Agent, or Firm*—Poms, Smith, Lande & Rose

[57] ABSTRACT

A construction of a building with the multiple floors underground for the interment of human remains, and with the multiple floors above the ground level for the use of storage of earthen jars of human bones or ashes. The floors underground are provided with earthen walls serving as the dead ends of the compartments and extending up from the very bottom soil of the building and connecting with natural earth. Longitudinal and lateral corridors are intersecting with each other at convenient intervals, and all are leading to the entrance of a given floor. Servicing at the entrances of all floors is elevator(s) going through the entire building, both underground and above.

7 Claims, 4 Drawing Sheets

HONEYCOMB TYPE OF STRUCTURE FOR INTERMENT OF HUMAN REMAINS

BACKGROUND OF THE INVENTION

The present invention relates a building with the honeycomb type (or cellular type) of structure which consists of compartment underground and above the ground level, providing ample space for high-density interment of human remains, or storage or earthen jars for human bones (i.e. the remains garnered and sealed in jars of the dead after years of interment) or ashes (i.e. what is left sealed in jars of the dead after cremation).

That all men are mortal is only natural. It has long been the institutional obligation and courtesy for those living to offer a decent land for interment of the deceased who once their loved ones. Due to the rapid increase of human race in the modern times leading to the high density of population especially in the big cities, the land available for human burial is growing appallingly dwindled. It is very expensive now in terms of money and time to have an old way of burial as it needs a coffin, a burial lot—which becomes extremely costly—the cement and the stone work, and the other necessary building materials to build a decent grave yard. Besides, as one coffin occupies one grave yard lot, the waste of the land is too appreciable. It appears that the modern men encounter kind of frustration when they attempt to find an appropriate site as a memorable grave offered to their deceased loves as a permanent resting place. This is how the problem that prompts the inventor to become aware of the urgency of the situation and determines to find out the way to overcome it. The inventor deems that in order to solve the problem with an appreciably long-term effect, it requires a well-conceived planning and a construction with a fitting structure that will offer the maximum interment in a minimum space with impressingly decent appropriateness.

SUMMARY OF THE INVENTION

The present invention relates a concrete construction consisting of a building with multiple floors underground for interment of coffins, with the ground level for administrative use, and with multiple floors above the ground level for storage of earthen jars of human bones or ashes. On each floor underground, there are parallel rows of compartments. The corridors between the rows of compartment are wide enough for free movement of the people visiting or employed to work there. Each compartment of the rows is built into three units by making three layers and vertical partitions, and the dimension of every unit is just right for accommodating one coffin. Cement blocks are used for the vertical partitions of the compartments. A removable tomb facing the corridor serves as the opening of a unit. The longitudinal corridors at both ends of the rows of compartments are provided and intersecting with the lateral corridors at conveniently spaced intervals, and all are leading to the entrance of a given floor. Elevator is used to provide for the up-and-down movement going all through the entire building both underground and above the ground level.

The rear, opposite to the removeable tomb, of each compartment of the front and the back rows is built with the earthen walls extending up from the very bottom of the building, which are connected with natural earth. Every central row consists of two parallel rows of compartments, the central front and the central back.

The middle space between the said two parallel rows is the earthen wall also extending up from the very bottom of the building. So that the dead ends (rear) of the central front and the central back compartments along the central rows share the common earthen walls. At the left and right extremities of the central rows of compartments, natural earth is connected with the running through the dead ends of the central compartments. It may well be the most outstanding part of this invention to have the earthen walls so built. For the main characteristics of the conventional inhumation (the way of remains-burial under land) is to place the coffins in physical contact with the soil of the earth around them so that whatever the organic or nonorganic elements from the decomposed corpases may find their way back to the earth which is the reservoir of life-giving resources ready again for life of the future generations. The earthen walls of this invention just serve the purpose characterized by the conventional inhumation as they act as passages leading to the earth for the elements from the deceased.

The ground floor of the concrete construction of this invention is reserved for administrative use while the compartments of all the other floors above the ground level are built into many units of the dimension, by using longitudinal and lateral partitions, for storage of earthen jars of human bones or ashes. As it can be noticed, there is no marked difference in terms of the general structure of construction between that underground and that above the ground level except that the latter is without the earthen walls.

DETAILED DESCRIPTION OF THE PREFERRED EMBODIMENT

Figure 1:
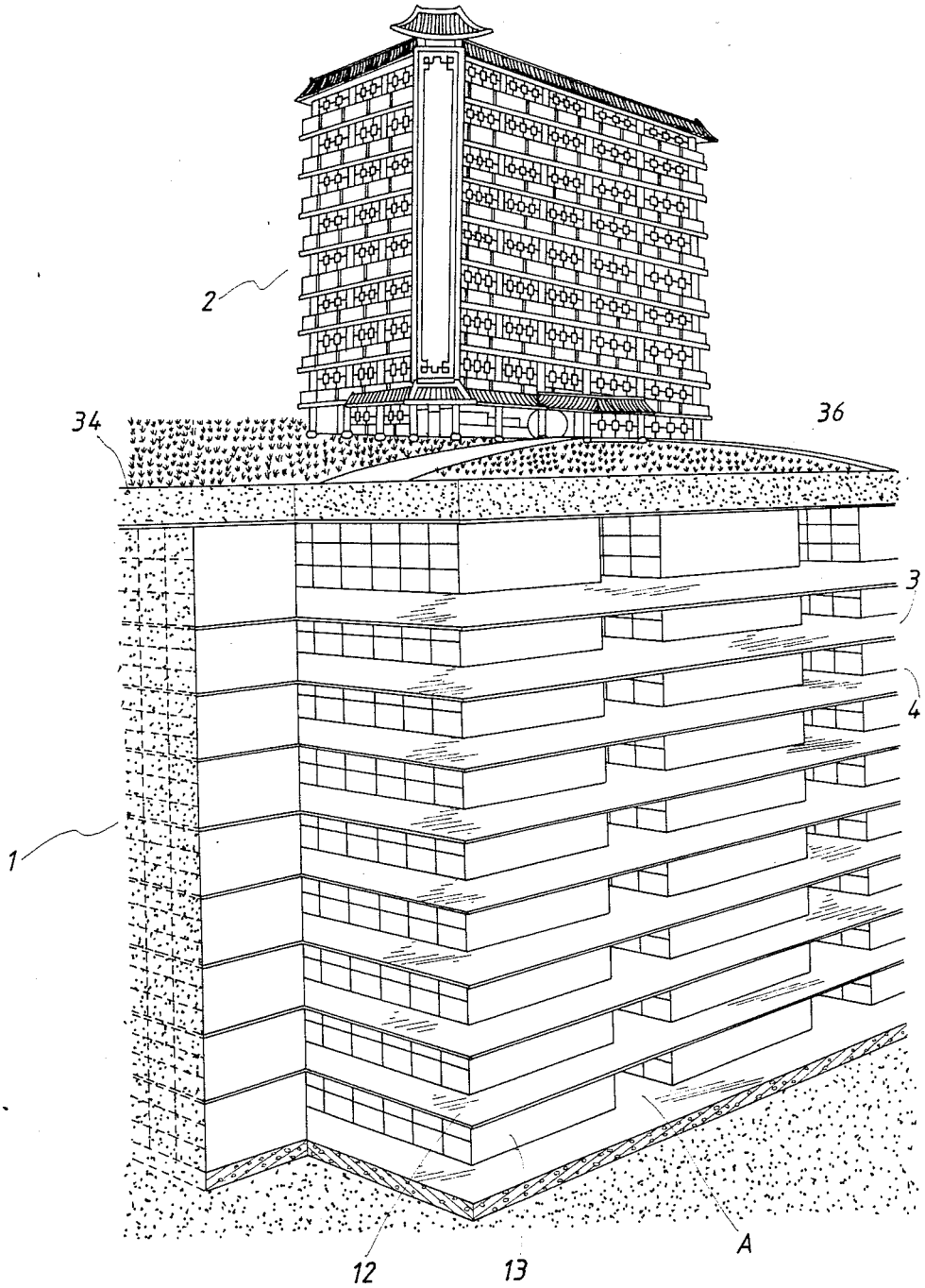
FIG. 1 is shown an examples of the general outlook of the building of this invention.
Figure 2:
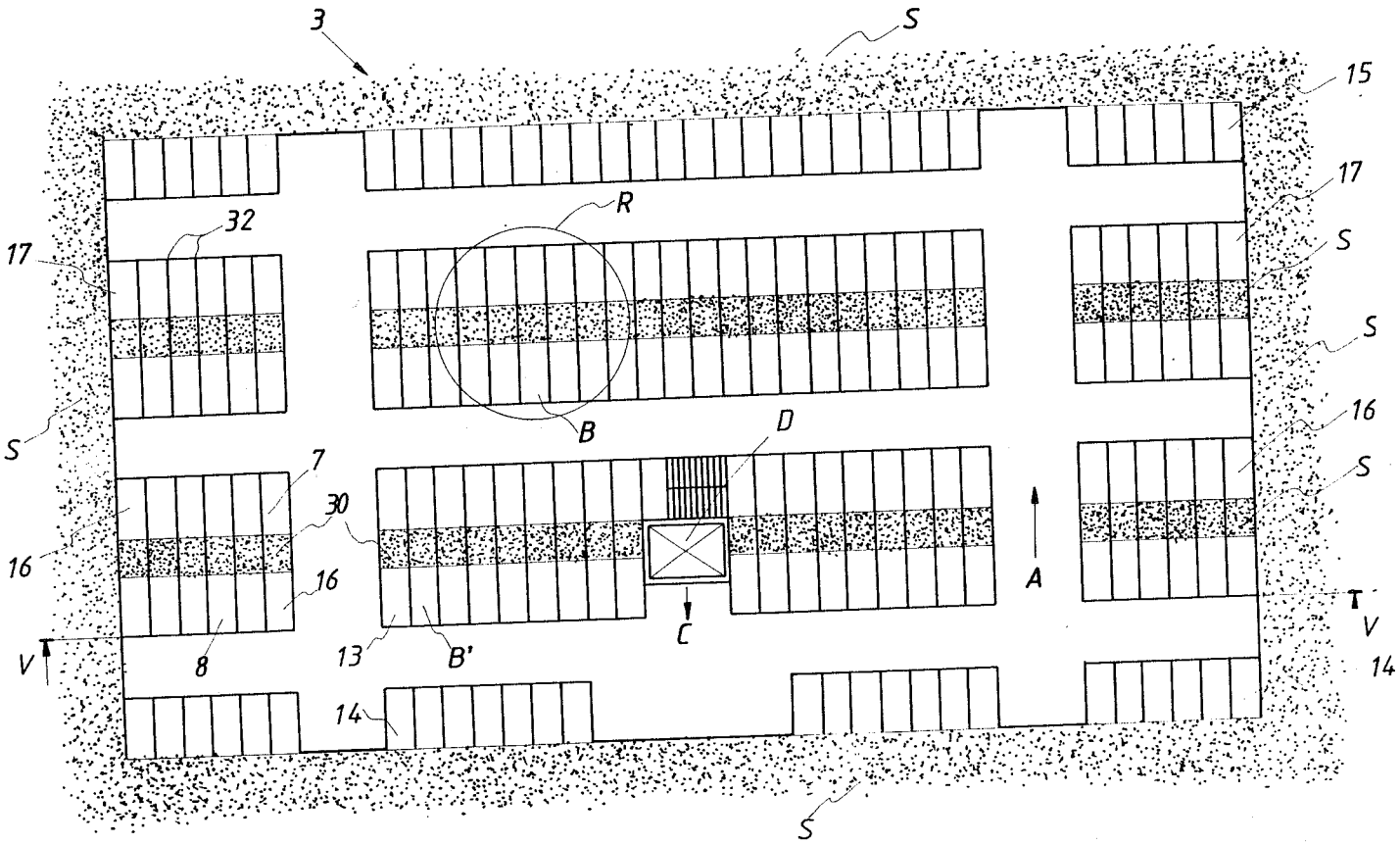
FIG. 2 is the plane view of the construction underground.
Figure 3:
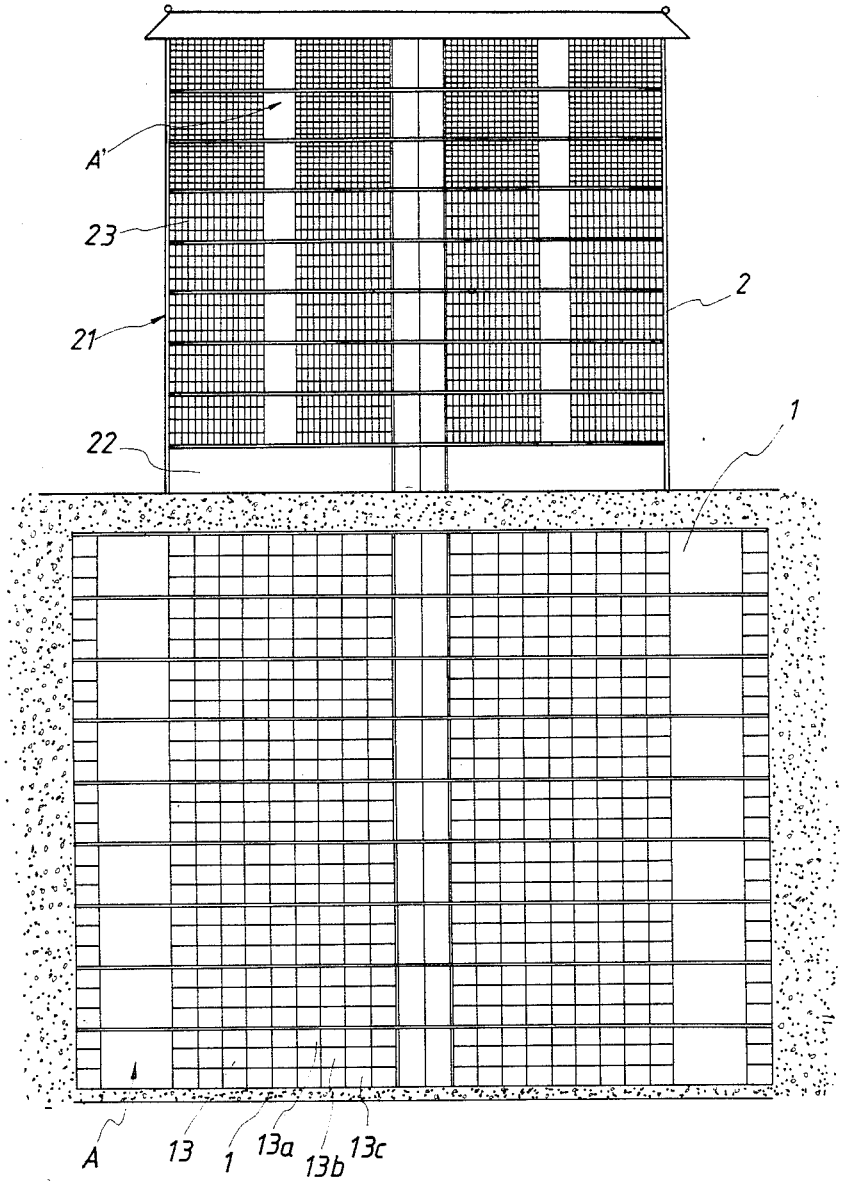
FIG. 3 is the cross section view V—V' of FIG. 2.
Figure 4:
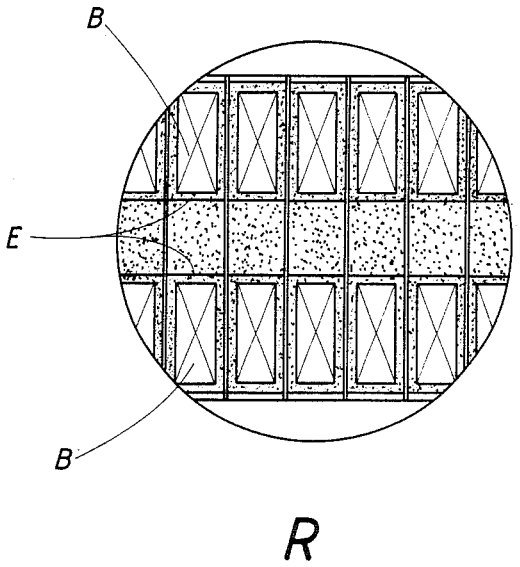
FIG. 4 is shown an enlarged view (R) of the part FIG. 2.

The present multiple-floor construction consists of two parts, one underground (1) and the other above the ground level (2). The use of the part underground (1) is for the interment of the dead sealed in coffins with the effect tantamount to conventional inhumation. The depth of the construction underground is dependent upon the number of floors 3 and 4 required. On each floor 3 (FIG. 2), there are parallel rows of compartments (13) and each compartment is built into three layers (13*a*, 13*b*, 13*c*) (FIG. 3). The front and the back rows (14, 15 are respectively of single rows of compartments with the dead ends built with eathen walls(s) which are connected with natural earth. Every central row (16, 17,) consists of two-single parallel rows like 7 and 8) of compartments, the central front and the central back, with the earthen walls 30 in the middle space of the two-single parallel rows serving as the dead end of the compartments. The earthen walls 30 extend up from the very bottom of the building and connect with natural earth, and laterally to join the earthen walls of the two extremities of the rows (s).

There are longitudinal and lateral corridors (A) between rows. Each compartment like 17 of the rows is built into three layers, and each layer is a unit 32 with the dimension just right for one coffin (not shown). Each opening end of the units are initially removeable tomb (B) and (B') serving as the door through which the coffin is slided into the unit. Once the coffin is in place, the tomb (B) is permanently sealed with cement (See FIGS. 2 and 3). The dead (rear) ends (E), opposite to the tomb end, of the units are built with earthen walls. All tombs face the corridors (A) and all corridors (A) lead to the entrance of the given floor (C). Servicing at the entrances is elevator(s) (D) going through all floors of the entire building (2).

The general structure and partitions of those above the ground level (2) are all but identical with those underground except that the former is without earthen walls. All compartments 21 above the ground level 34 are built, by longitudinal and lateral partitions (23), into units with the dimension of each suitable for storage of earthen jars of human bones or ashes. For beautification of the environment around the ground level (surrounding the first floor 22), trees and flowers 36 be planted. The full and lasting flourish of the botany in this area can well be assured for the soil thereof is amply fertilized with the organic and nonorganic elements from the decomposed corpses in interment through earthen walls built in the underground.

According to the structure of the interment of this invention disclosed above, the advantages thereof are as follows:

(1) An economic utilization of the burial lots available.

(2) The effect of the customary earthen inhumation being maintained, and other ways of keeping the remains of the dead being efficiently settled.

(3) Not much on-the-spot building work, like that of the new grave yard, for instance, of the interment being necessary since the major part of the work such as tomb and excavation, etc. has been accomplished and ready. Less expenses, therefore, involved as compared to the conventional burial.

(4) Achieving the environmental beautification with the botany fertilized by the natural resources from the interment of this invention.

(5) Facilitating the effecient administration of the interment and storage of the other forms of human remains.

I claim:

1. A cellular structure honeycomb-type building for human interment, comprising:

a plurality of floors, at least one of said floors being underground and at least one of said floors being above ground level;

each underground floor divided into a plurality of compartments, said compartments arranged in parallel rows and separated by a plurality of longitudinal and lateral corridors which allow access to each of said compartments;

each compartment being subdivided into a plurality of layers;

each layer defining a unit tomb space adapted to receive a single coffin;

each of said compartments communicating with at least one earthen wall;

whereby said coffin within said unit tomb space is in contact with said earthen wall allowing any corpse within said coffin to decompose and mix with the earthen walls, leaving behind in said unit space human remains which may be collected and relocated, so that said unit tomb space may be reused at some future date.

2. The cellular structure honey-comb-like building for human interment of claim 1, including:

an elevator and elevator shaft, connecting each of said floors to one another;

whereby, each of said underground and above ground floors may be serviced.

3. The cellular honeycomb-type building for human interment of claim 1, wherein earthen walls which communicated with centrally-positioned compartments extend to intersect earthen walls located along a perimeter of said floor.

4. The cellular honeycomb-type building for human interment of claim 1, wherein the rear ends of each compartment along a perimeter of said underground floors abut an earthen wall.

5. The cellular honeycomb-type building for human interment of claim 1, wherein each of said above-ground level floors have a plurality of partitions which divide each of the floors into storage units adopted for storing earthen jars of human remains such as remains gathered from underground tombs, so that as said remains are transferred from underground to an above-ground location, the underground unit tomb spaces from which said remains are removed may be revised.

6. The cellular honeycomb-type building for human interment of claim 1, wherein partitions are formed between compartments with cement blocks.

7. A cellular structure for human interment, comprising:

a building having at least one floor which contacts the earthen ground along at least one surface of said floor and one floor above ground;

the floor below ground defining tombs for receiving coffins which abut said earthen ground allowing human remains to decompose within said tombs;

the floor below ground having corridors for accessing said tombs and removing human remains which have decomposed;

the floor above ground providing storage compartments for storage of decomposed remains transferred from said floor below ground;

whereby, a human interment system is realized which allows reusable below ground tombs and the transfer of decomposed remains to above ground locations.

* * * * *